United States Patent [19]

Crye et al.

[11] 4,336,894

[45] Jun. 29, 1982

[54] TICKET DISPENSER

[76] Inventors: LeRoy D. Crye, 13906 Hickory St., Omaha, Nebr. 68144; Leonard F. Fischman, 5209 Emeline St., Omaha, Nebr. 68157

[21] Appl. No.: 155,541

[22] Filed: Jun. 2, 1980

[51] Int. Cl.[3] ..... B65G 59/08

[52] U.S. Cl. ..... 221/280

[58] Field of Search ..... 221/280, 279, 261; 133/6, 1 R; 206/39.5, 39.6; 312/60, 61

[56] References Cited

U.S. PATENT DOCUMENTS

| | | | |
|---|---|---|---|
| 1,126,139 | 1/1915 | Walker | 206/39.5 X |
| 1,202,086 | 10/1916 | Moe | 312/61 |
| 1,454,445 | 5/1923 | Lieberman | 133/6 |
| 2,431,121 | 11/1947 | Hunter | 221/279 X |
| 2,656,233 | 10/1953 | Bollman | 312/61 |
| 3,316,924 | 5/1967 | Ware | 133/1 R |

*Primary Examiner*—Stanley H. Tollberg

*Attorney, Agent, or Firm*—Hiram A. Sturges

[57] ABSTRACT

A ticket dispenser having a hollow body receiving a stack of tickets in its upper portion, a ticket pushing head in the body and pressed upward by a spring, the body guiding movement of the head along a vertical axis, a ticket exit slot at the top of the forward side of the body, a ticket manipulation opening on the upper side of the body, the upper side of the body being substantially inclined with respect to the axis so as to make easier the pushing out of tickets, the body having one or more access openings therethrough to assist in manipulating tickets, and a strap on a side of the body to facilitate holding.

12 Claims, 6 Drawing Figures

TICKET DISPENSER

BACKGROUND OF THE INVENTION

Size and price tickets for clothing labeling and for labeling other merchandise have been applied to clothing in the past by putting them on the needle of a gun, while shooting a plastic attachment device through the ticket and through a portion of the garment. Such attachment devices have enlarged ends that keep the ticket from coming off.

In the past, it has been the habit of merchandise marking personnel to hold the tickets loosely in their hand which restricts movement of the hand.

A typical ticket is two inches long and one inch wide, although sizes vary. The tickets are commonly rectangular.

Since one hand is totally needed to hold the attachment applying gun, therefore, a person's other hand must hold the group of tickets, move a ticket forward from the group so that it can be separately speared by the needle, and at the same time, must take hold of the clothing article like the cuff, for example, and then hold the cuff in position while the gun hand shoots the attachment device through a hollow needle to fasten the ticket.

It is awkward to do this when tickets are loosely held in the hand, as in the prior art. Only a few tickets can be held in the hand at once, and even then, there is danger that they might fall on the floor in the process once in awhile.

The objective of this invention is to provide a dispenser which will firmly hold the tickets and which will permit an upper ticket to be slid from the top of the pile out into a position for application with the dispenser being shaped for giving a maximum opportunity for freedom of the fingers in handling the clothing.

We have discovered a perfect shape is for the tickets to be held at a slant of approximately 45°, for example, with respect to the elongation of the dispenser. This causes the uppermost end of the dispenser to be narrow, and therefore, interfering less with movement of the fingers in handling the clothing.

We have also discovered that the provision of having the tickets held at slant with respect of the elongation of the dispenser makes it possible for approximately two-inch tickets to be held in a dispenser having an inner dimension of only one and 7/16", whereby its outer dimension is at minimum, and therefore, it is not bulky and provides maximum freedom for the use of the hands in gripping, not only the dispenser, but also the clothing.

Another objective is to provide a convenient handle, preferably a loop of comfortable flexible material fixed to a side of the dispenser body, whereby an operator can support the dispenser body on inner portions of the fingers while permitting the majority of finger-length to be unneeded for such support and available for handling clothing.

Another objective is to provide the handle with adjustable attachment so that it can be positioned at various distances from the outlet end of the dispenser to accommodate persons having hands of various sizes and to adapt to persons who would prefer that only three of their fingers be in the handle, instead of all four.

Yet another objective is to provide alternate attachment for the handle so that it can be on the right or left side of the dispenser for use with right or left-handed persons.

Another objective is to provide the feature of the removal of a pressing head and the compression spring so that tickets can be inserted into the dispenser body from the lower end. Then, the pressing head and the compression spring can be put back into the dispensing body thereafter.

Another major objective of this device is to increase the productivity of the marker in the work place.

SUMMARY OF THE INVENTION

A major goal of this invention is to provide a ticket dispenser having a hollow body receiving a stack of tickets in its upper portion, a ticket pushing head in said body and pressed upward by a spring, said body guiding movement of said head along a vertical axis, a ticket exit slot at the top of the forward side of the body, a ticket manipulation opening on the upper side of the body, the upper side of the body being substantially inclined with respect to the axis so as to make easier the pushing out of tickets. Another goal is to provide the body with one or more access openings therethrough to assist in manipulating tickets to straighten them out if they should come out of alignment with the slant of the top of the head.

Another goal is to provide a strap on a side of the body to facilitate holding the body, the strap being adjustable to different hand sizes and securable on the right or left hand sides of the body.

DESCRIPTION OF THE PREFERRED EMBODIMENT

Figure 1:
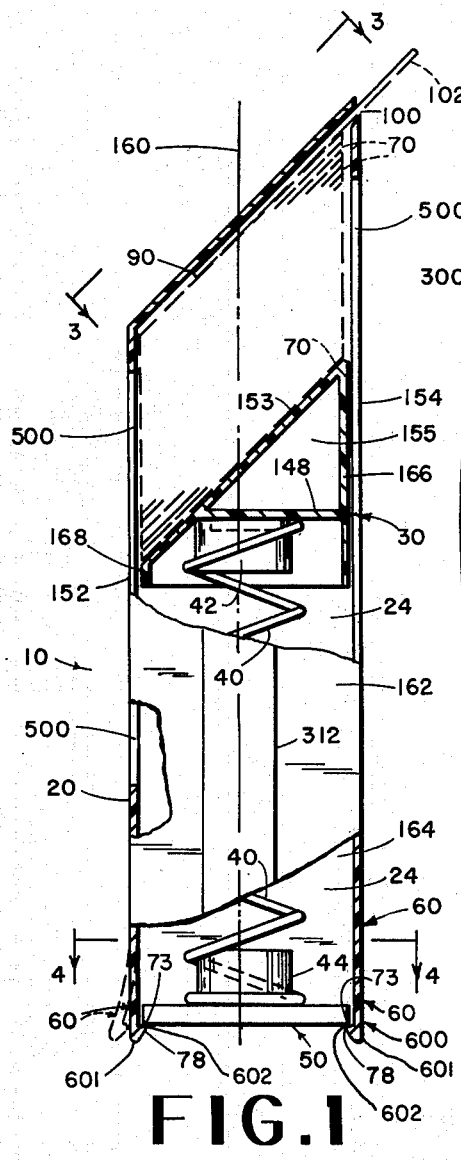
FIG. 1 is a right side elevation of the ticket dispenser of this invention, shown with upper and also a lower portion of the right side thereof broken away, for showing interior parts in section, most of a head being shown in section because the adjacent half is removed, one of the cap retaining arms being shown in dotted lines in a releasing position, a stack of tickets being shown in dotted lines and partially diagrammatic.
Figure 2:
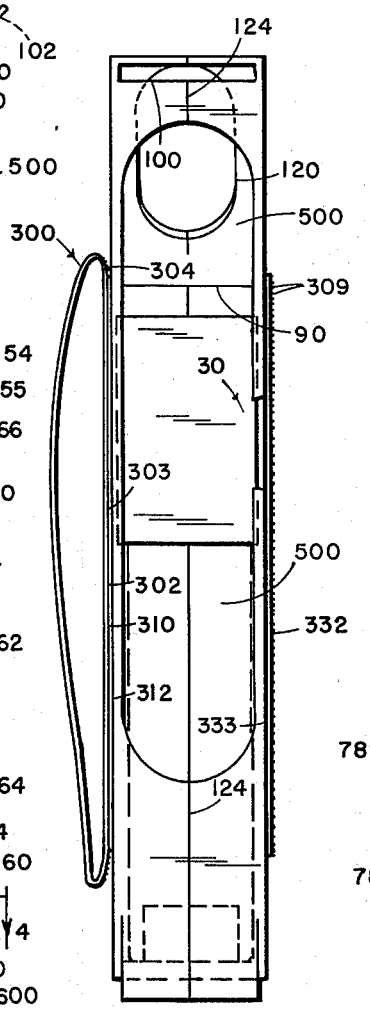
FIG. 2 is a frontal elevation of the dispenser as seen from the right side of FIG. 1.

In FIG. 1, the ticket dispenser hereof is generally shown at 10, and the hollow body of the dispenser is there generally indicated at 20 and has a rectangular interior opening 24 in which a pressing head 30 moves back and forth under the urging of a spring 40 received on a boss 42 fixed to the lower side of the head 30 and having its other end received on a lower boss 44 fixed to the innerside and upwardly projecting from an end cap 50, best seen in FIG. 2, centered on the center line 160.

In FIGS. 1 and 2 the method of holding the end cap 50 in place is shown, and the method consists of a pair of flexible arms 60 which are of one-piece with the body 20. The arms 60 are fixed permanently to the body 20 in a manner such that the lower ends of the arms 60 can be flexed outwardly away from the body 20, such as into a sample outer position shown in dotted lines at 60 on the left of FIG. 1.

This permits the cap 50 to be removed for removal of the spring 40 and the head 30 so as to be able to put tickets 70 in place in the upper end of the dispenser. A stack of tickets 70 is disposed inbetween the head 30 and the upper end panel 90 of the dispenser of FIG. 1.

When it is desired to put the cap 50 back in place after loading, then it can be simply pressed upwardly between upwardly and inwardly inclined surfaces 78 of the lower ends of arms 60.

The inclined surfaces 78 are on those inner sides of the outer ends of the arms 60 which face a vertical center line 160 of the vertically elongated body 20, as seen in the right side elevation, FIG. 1. The lower ends of the arms 60 each have a horizontal shoulder 73 transverse to their length.

The shoulders 73 prevent the cap 50 from moving downward, but permit pressing of the arms 60 out of the way to one side at their lower ends so that the cap 50 can be removed when desired for reloading.

It is important that there be a ticket outlet slot 100 extending through the forward side panel 154 of the body 20, the slot 100 being horizontally elongated and of sufficient length to permit the width of a ticket to pass therethrough and one such ticket is shown in dotted lines at 102 in FIG. 1, extending through the outlet 100 partially.

Figure 3:
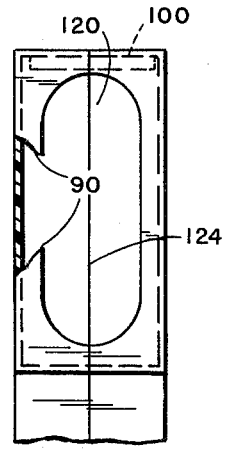
FIG. 3 is a view taken along the line 3—3 of FIG. 1, with a portion of the upper wall being broken away.
Figure 4:
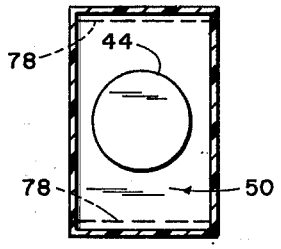
FIG. 4 is a sectional view, taken along the line 4—4 showing shoulders on arms in dotted lines.

The upper end panel 90 of the dispenser is provided with a manipulation opening 120 therethrough which is seen in FIG. 3 and which is vertically elongated.

The opening 120 receives the operator's thumb therethrough for pressing each ticket out.

Figure 5:
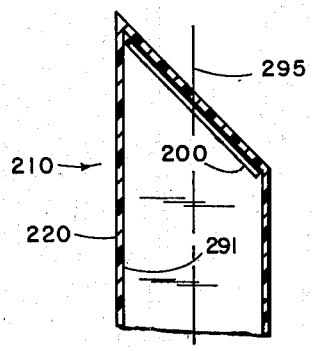
FIG. 5 is a sectional view taken along the line 5—5 of a modified dispenser shown in FIG. 6, and having a double slanted top.
Figure 6:
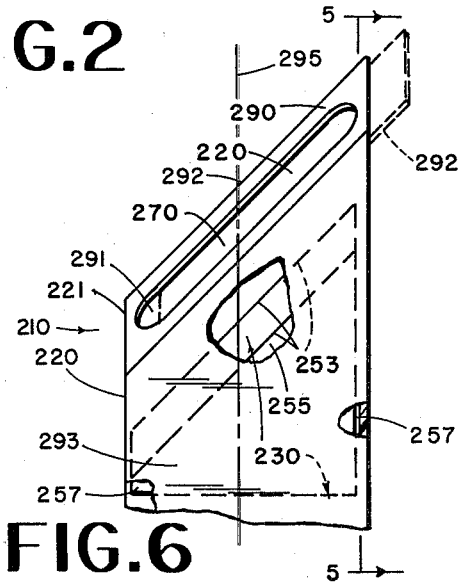
FIG. 6 is a right side elevation of a modified dispenser having a double slanted top, the lower portion and certain side wall portions of the body being broken away and showing an upper ticket partially projecting.

Referring to FIGS. 5 and 6 there are times when a ticket is so wide that in order to keep such wide tickets in the dispenser, without making the dispenser of undue bulk in cross-sectional size, a special upper end 209 of the dispenser is slanted in an extra direction.

First of all, it is slanted as the dispenser of FIG. 1 is slanted. In FIG. 1 the dispenser is looked at from the right side and its uppermost panel 90 slants upwardly and forwardly. In the double-slanted modification of FIGS. 5 and 6 the same slant that is seen in FIG. 1 prevails also, but in addition there is an extra slant because FIG. 6 is a right side elevation just as is FIG. 1, and the upper panel 290 slants upwardly to the left so that the left side 291 of the body projects upward farther than the right side 293, with the upper face of the upper panel 290 inclining at perhaps 45° with respect to the vertical axis 295 of the dispenser, as best seen in FIG. 5. The axis 295 extends down the center of the dispenser body 220.

The FIG. 6 modification has an opening 270 in its upper wall 290 for the pushing out of tickets such as the upper ticket 292.

The head 230 of FIG. 6 has its uppermost surface 253 slanted in parallelism with the underside of the top wall 290 of the modified body 221 of FIG. 6.

The pushing head 293 has a shape shown only diagrammatically in FIG. 6, and it has right and left parallel vertical walls 255 and forward and rearward parallel vertical walls 257 and in that way is similar to the head 30 and can be identical thereto except for the double slanted upper face 290.

In FIG. 2 a handle is shown at 300 and is essentially a loop made of flexible material which is comfortable to the hand, and preferably simply made of a fabric covered on its side 302 with a clinging material 303 called VELCRO, which latter has a lot of loops 304 on it so as to be engaged by hooks 309 that project from a mated piece 310 of VELCRO, which latter is suitably glued to the right side of the body 20, the glue being at 312 in FIG. 2.

A piece of mated VELCRO 332, having hooks 309, can be glued on the left side of the body 20 by glue 333 for right-handed persons, but it can also be on both sides, so that the same dispenser can be used alternately by right and left handed persons using the same removable handle 300.

The handle loop 300 can be set higher or lower, since it is removable from the mated VELCRO strip 310.

The inclination of the upper wall 90, as it would be seen from the right or left sides of the body is preferably 45°, but it is to be understood that any amount of inclination is a help, as distinguished from having the top be at 90° with respect to the vertical. Therefore, inclinations in a range between 15° with respect to the horizontal and 85° with respect to the horizontal are in a range of usefulness.

The same thing is true of the inclination of the upper wall 290 of FIGS. 5 and 6, as it would be seen in section taken along in vertical plane slicing the body at any point from the rearward to the forward side thereof, such as long the line 5—5 of FIG. 6. This inclination of FIG. 5 is, therefore, preferably 45°, but it could also be any inclination and be an improvement over having the upper wall 290 at a right angle to the vertical axis 295. For example, a range between 15° and 85° with respect to the vertical would be a useful range for the inclination of the wall 290 as it would be seen in FIG. 5.

In FIG. 1 the body 20 is seen to have a rearward panel 152 and a forward panel 154. These two panels each have a ticket manipulation hole 500 in them, and each hole 500 is quite long. The upper end of the forward hole of one of the holes 500 is spaced from, but closely adjacent to the ticket opening 100, and its lower end can extend to a point, for example, two-thirds from the top to the bottom of the dispenser.

The hole 500 on the rearward side can have its lower end as the same level of the hole 500 on the forward side. The upper end of each of the holes 500 can be, for example, between $\frac{1}{4}''$ and $\frac{1}{2}''$ from the top of the dispenser.

The pushing head 30 has an upper panel 153, the top part of which is inclined at an angle of 45° preferably with respect to a vertical axis 160, which later is spaced equidistantly from the forward and rearward walls 152 and 154 and from the vertical right and left walls 162 and 164.

The pushing head 30 has right and left side wall panels 155 attached to its top panel 153 and to the forward and rearward panels 166 and 168 of the pushing head 30. The pushing head 30 further has a boss-supporting panel 148 extending horizontally and connected to the forward and rearward walls 168 and to the side wall panels 155. Panel 148 is disposed sufficiently above the lower end of the pushing head 30 that the boss 42 is received within the pushing head 30.

The pushing head 230 of FIG. 6 has an upper panel 253 parallel with the inner side of the upper wall 290 of the dispenser 210 of FIG. 6, which means that it has a double inclination with respect to the vertical axis 295, the same as does the top panel 290 of the body. Otherwise, the pushing head 230 of FIG. 6 can be the same as the pushing head 30 of FIG. 1.

In FIG. 5 at 200 an inclined ticket outlet slot is shown serving the same purpose as the slot 100 of FIG. 1, the slot 200 being parallel with the top panel 290 seen in FIG. 6.

In FIG. 2, it will be seen that the body can be made from right and left half portions joined together with glue or other bonding means along a vertical plane indicated by the glue line 124 in FIG. 2.

The cap 50 is held in place by a cap retaining assembly 600 comprising having the end cap 50 and the body 20 having at least one set of mutually lapping portions defined by a lower end 601 of an arm 60 and an adjacent edge 602 of the bottom of the cap 50. In FIG. 1, 2 sets of mutually lapping portions are shown, since there are two arms 60.

Each lapping portion 601 of a set of mutually lapping portions has on it an interlockable element defined by a shoulder 73 cooperative with an interlockable element on the other lapping portion 602 of the cap, the other interlockable element being the edge of the bottom of the cap shown at 602 whereby the cooperative interlockable elements described lock the end cap 50 and the body 20 together sufficiently to help retain the end cap in place against the edge of the spring 40.

At least one of lapping portions 601,60, specifically an arm 60, is flexible and resilient and moveable away from its normal state position so that its interlockable element 601 separates from the other of the interlockable elements 602 whereby they cease to interlock and no longer prevent the cap 50 from being temporarily removed from said body as is useful for the filling of the body with tickets.

We claim:

1. A ticket dispenser having a hollow body for receiving a stack of tickets in its upper portion, a ticket pushing head in said body, a spring in said body beneath said head and pressing upwardly on said head, said body guiding movement of said head along a vertical axis, said body having upwardly extending side walls one of which is a forward side, an exit slot through the top of said forward side, said body having an upper wall, a ticket manipulation opening through said upper wall large enough to receive an operator's thumb as it presses a ticket toward said exit slot, the inner and outer sides of said upper wall of said body being inclined with respect to said axis sufficiently as to make substantially easier the pushing out of tickets, means retaining the said spring in said body, said spring-retaining means comprising a cap means engaging the lower end of said spring, cap-retaining said cap means from downward movement with respect to said body, said cap-retaining means comprising said end cap means and said body having at least one set of mutually lapping portions, each lapping portion having an interlockable element thereon cooperative with an interlockable element on the other lapping portion and assisting in a locking of said end cap means and body together when said interlockable elements are in normal state positions so as to help to retain end cap from moving away from a center of said body, at least one of said lapping portions being flexible and resilient and movable away from its normal state position so that its interlockable element separates from the other of said interlockable elements whereby they cease to interlock and no longer prevent said cap from being temporarily removed from said body for the filling of said body with tickets.

2. The ticket dispenser of claim 1 having said cap-retaining means being two flexible resilient arms fixed to opposite sides of said body, upwardly facing shoulder means on the inner sides of each of said arms, said arms and shoulder means being positioned for the normal engagement of said shoulder means with the underside of said cap for retaining said cap, said arms being sufficiently flexible that they can yield outwardly at their lower ends permitting said cap to pass between said such arm portions as are disposed below said shoulders.

3. The ticket dispenser of claim 1 having said head having a recess on its underside, the upper end of said spring being received in said recess.

4. The ticket dispenser of claim 1 having an upper boss in said recess and secured to said head and downwardly projecting and receiving said spring therearound.

5. The ticket dispenser of claim 1 having an elongated strap extending upwardly along a side of said body, means securing each end of said strap to said body.

6. The ticket dispenser of claim 1 having said strap securing means comprising two mated Velcro strip means secured one strip means to said body and the other strip means to said strap, said one Velcro strip means extending a substantial distance upwardly along said body whereby said body-attached Velcro strip means is engageable by said strap-attached Velcro strip means along a substantial vertical area for adjustability.

7. The ticket dispenser of claim 1 having said body having right and left upwardly extending sides defining a pair of sides, said upper wall having also a second inclination so as to be lower along one of said pair of sides than the other substantially from the forward to the rearward sides of said body.

8. The ticket dispenser of claim 1 having an extra and like body-attached Velcro strip on an opposite side of said body from said first-mentioned body-attached strip.

9. The ticket dispenser of claim 1 having a ticket manipulation hole in an upwardly extending side of said body and of a vertical length and size such that when tickets are out of parallelism with the interior of said upper wall the operator can manipulate the tickets through said manipulation hole to bring them into parallelism with the interior of said upper wall.

10. The ticket dispenser of claim 1 in which said inclination is between 15° and 85°.

11. The ticket dispenser of claim 1 in which said body is made from two half portions secured together by a suitable bonding means.

12. The ticket dispenser of claim 1 having a lower boss secured to the upper side of said cap and receiving a lower end of said spring therearound.

* * * * *